United States Patent [19]

Cranston et al.

[11] 4,193,627

[45] Mar. 18, 1980

[54] LIFTING HOOK WITH SAFETY LATCH

[75] Inventors: Albert W. Cranston, Oregon City; William J. Rowell, Clackamas, both of Oreg.

[73] Assignee: Cranston Machinery Co., Inc., Oak Grove, Oreg.

[21] Appl. No.: 922,831

[22] Filed: Jul. 10, 1978

[51] Int. Cl.[2] ..... B66C 1/36

[52] U.S. Cl. ..... 294/82 R

[58] Field of Search ..... 294/82 R, 78 R, 77 DA, 294/15, 17, 26, 83 R; 24/230.5, 241 P, 241 PP, 241 PS; 254/73, 131.5, 132

[56] References Cited

U.S. PATENT DOCUMENTS

| | | | |
|---|---|---|---|
| 3,918,758 | 11/1975 | Fournier | 294/83 R |
| 3,922,028 | 11/1975 | Svensson et al. | 294/82 R |

*Primary Examiner*—James B. Marbert

*Attorney, Agent, or Firm*—Lee R. Schermerhorn

[57] ABSTRACT

A lifting hook has a spring biased safety latch to close the gap between the shank and the point of the hook. The hook is manipulated by a bent handle on the back side of the shank. A latch release cable extends along the handle in spaced relation thereto in the manner of a bow string. An operator can grasp the handle alone to manipulate the hook without releasing the latch or the cable can be included in the grasp when it is desired to release the latch.

5 Claims, 6 Drawing Figures

FIG. 3
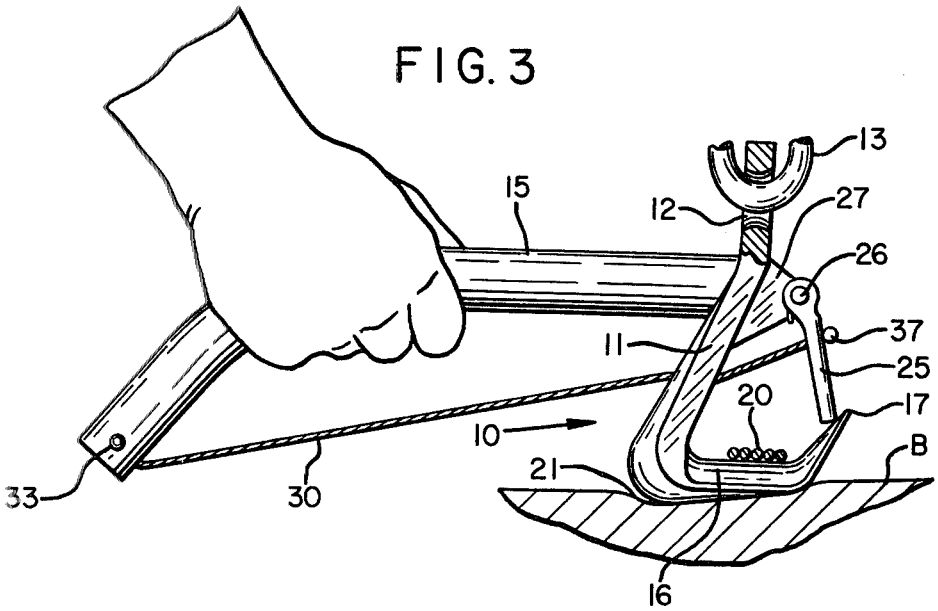
FIG. 4
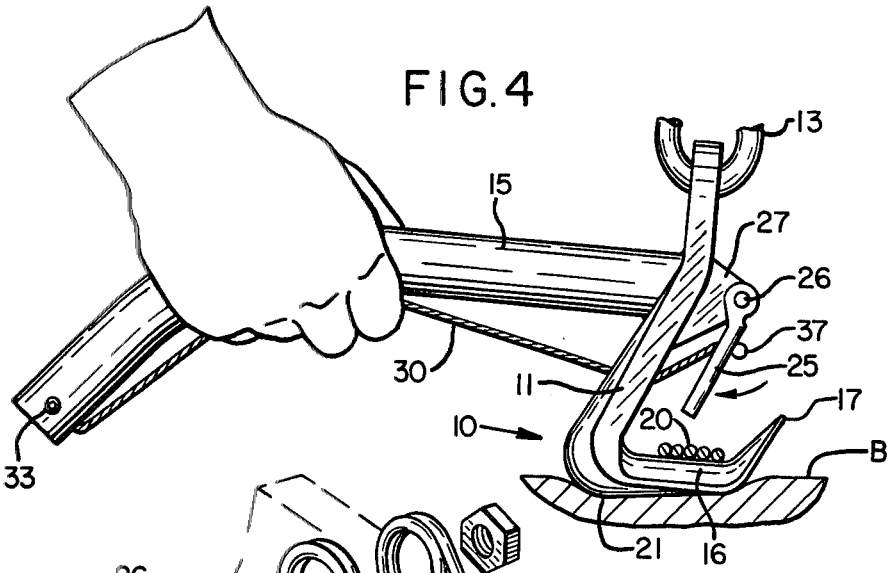
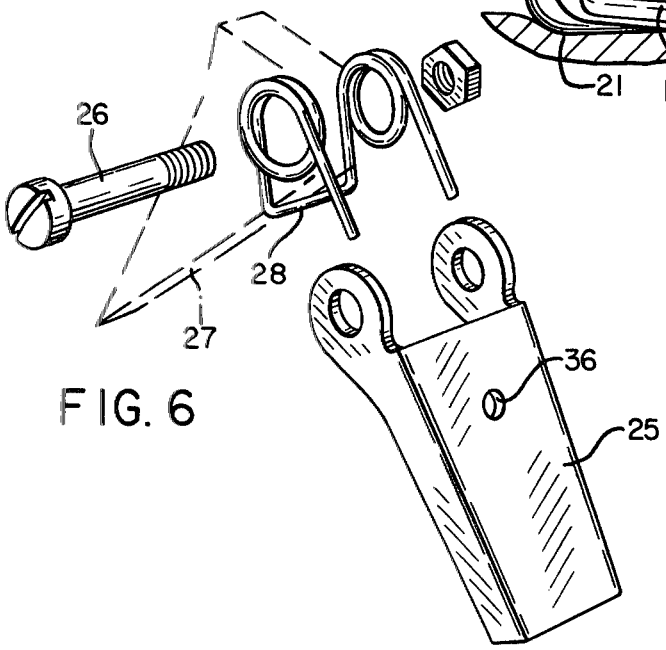
FIG. 6

LIFTING HOOK WITH SAFETY LATCH

BACKGROUND OF THE INVENTION

This invention relates to a manually engagable and disengagable lifting hook for lifting a bound package by its binding.

The present invention is an improvement on the lifting hook in U.S. Pat. No. 3,782,772. In the hook in said patent a stationary nose member projects from the shank of the hook to narrow the gap between the shank and the point of the hook and assist in preventing accidental disengagement of the hook from the binding on a package to be lifted by the hook.

Accidental disengagement is still possible however, so the primary object of the present invention is to provide an improved safety latch on such a hook to positively prevent accidental disengagement of the hook from the binding on a package to be lifted.

Additional objects are to provide convenient release means for such a safety latch and to provide release means which may be excluded from the operator's grasp on the handle when the operator is inserting the point of the hook under a binding on a package and which may be included in the operator's grasp to allow the operator to remove the hook from the binding.

SUMMARY OF THE INVENTION

The present hook has a bent manipulating handle for manually inserted the point of hook under the binding on a package to be lifted and for withdrawing the point of the hook when the hook is to be disengaged from the binding. In order to prevent accidental disengagement of the hook from the binding a spring biased safety latch is arranged to close the gap between the shank and the point of the hook after the point of the hook has been inserted under the binding. A latch release cable extends along the handle in spaced relation thereto in the manner of a bowstring.

Thus, an operator can grasp the handle alone to manipulate the point of the hook under the binding without releasing the latch and when it is desired to withdraw the point of the hook from under the binding the cable may be included in the grasp on the handle to release the latch.

The invention will be better understood an additional objects and advantages will become apparent from the following description of the preferred embodiment illustrated in the accompanying drawings. Various changes may be made in the details of construction and arrangement of parts and certain features may be used without others. All such modifications within the scope of the appended claims are included in the invention

BRIEF DESCRIPTION OF THE DRAWINGS

FIG. 3 is a similar view showing a further manipulation of the hook to cause the binding to pass the safety latch and become securely engaged by the hook.

FIG. 4 is a similar view showing the manipulation of releasing the safety latch so that the point of the hook may be withdrawn from under the binding.

FIG. 6 is an exploded view of the safety latch.

DESCRIPTION OF THE PREFERRED EMBODIMENT

Figure 1:
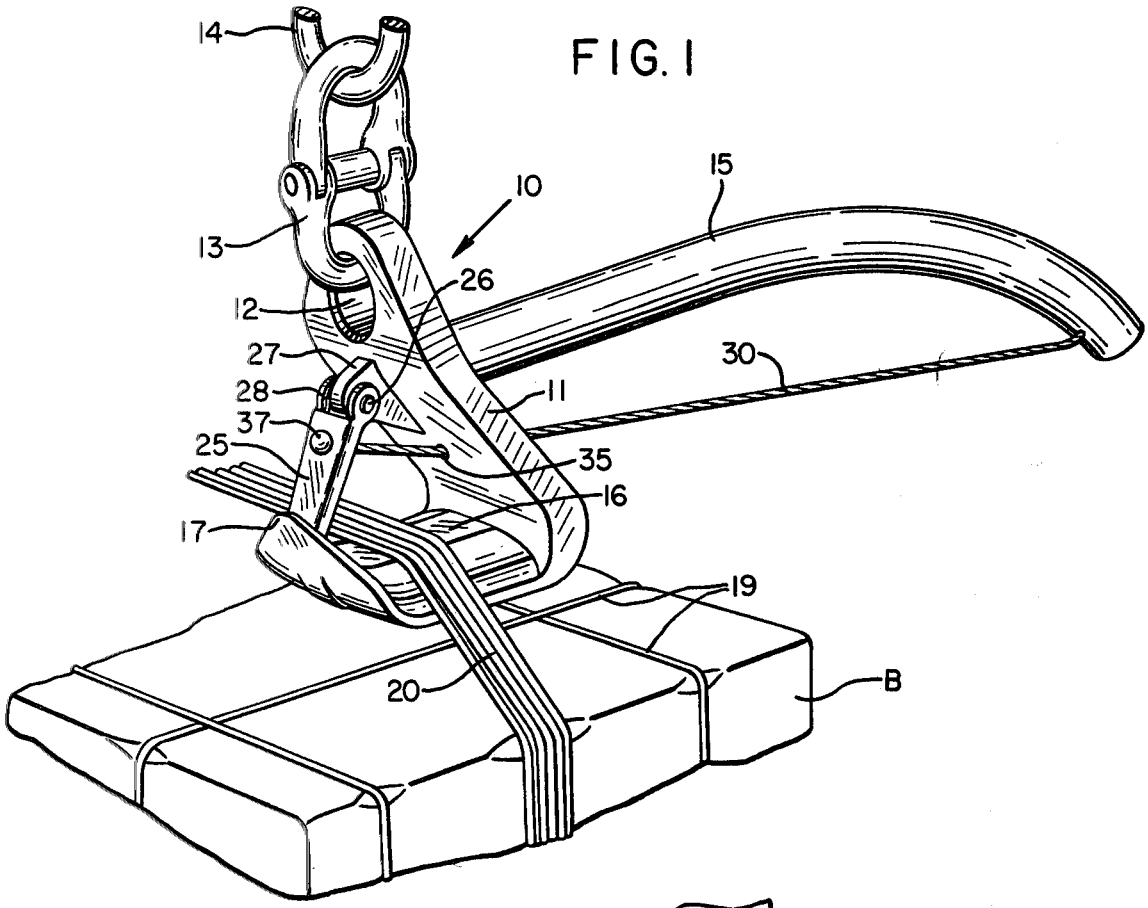
FIG. 1 is a perspective view of a lifting hook embodying the invention, in operative position.

Hook 10 has a shank portion 11 with a lifting eye 12 in its upper end for lifting a load by means of shackle 13 and chain 14. Welded on the back of shank 11 is an elongated downwardly curved handle 15 for manipulating the hook as will be described. On the lower end of shank 11 the hook has a throat with a normally horizontal lifting portion 16 terminating in an upwardly inclined point 17.

The hook is designed for lifting a unit package weighing approximately 4,000 lbs., comprising a plurality of individual bundles B. Each bundle B is bound by suitable binding 19 and the plurality of bundles B are bound together into the unit package by a binding 20 which is lifted by the hook 10. Binding 20 may comprise round wires as shown, metal straps or ropes. In lifting a unit package of large size as described there would be another hook 10 engaging the binding 20 at the opposite end of the package as shown in said U.S. Pat. No. 3,782,772.

Figure 2:
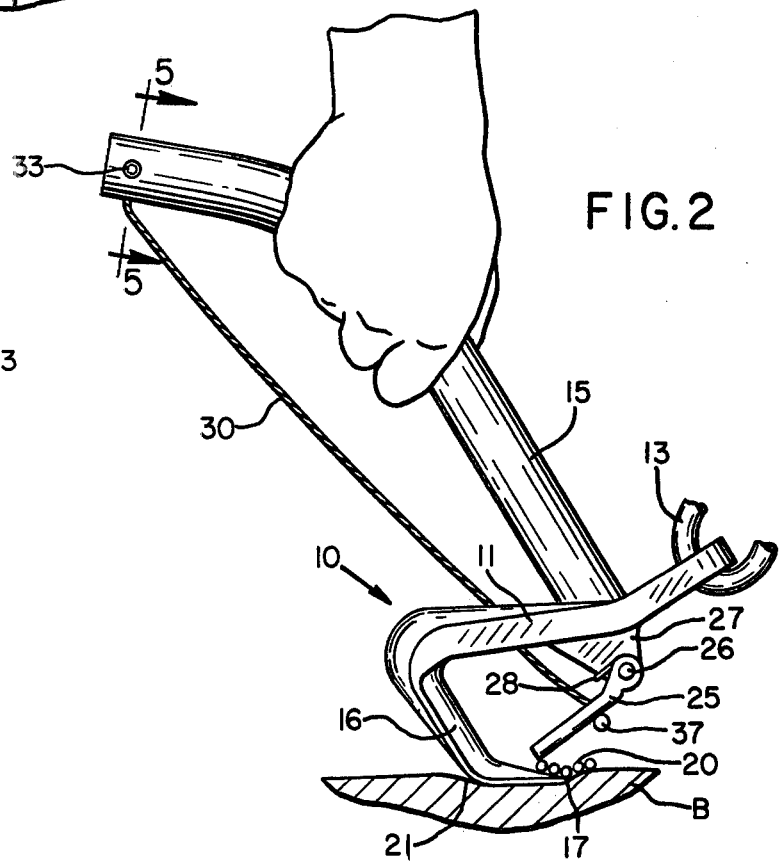
FIG. 2 is a side elevation view illustrating a first manipulation in the operation of engaging the point of the hook under a tensioned binding on top of a package.
Figure 5:
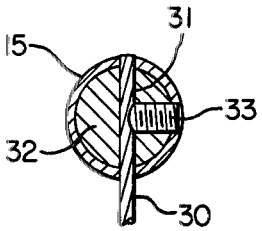
FIG. 5 is a view on the line 5—5 in FIG. 2.

By way of example in the present instance the bundles B are bales of paper pulp individually wrapped in sheets of paper making a somewhat resilient unit package wherein the binding 20 is tensioned sufficiently to indent itself to some extent into the surface of the package as indicated by the indentation at 21 in FIG. 2. This condition presents a problem in engaging the hook under the binding 20 and in disengaging the hook with facility and safety.

In order to prevent accidental disengagement of the hook from binding 20 a safety latch 25 is pivotally mounted on a pin 26 in a bracket 27 on the front side of shank 11. The lower end of latch 25 is normally pressed against the inside surface of point 17 by a torsional spring 28 on the pin 26. In this position as shown in FIGS. 1 and 3 the latch 25 closes the gap between shank 11 and point 17 to positively prevent disengagement of binding 20 from the hook.

Latch 25 is released by cable 30 when it is desired to withdraw the point of the hook from binding 20. One end of cable 30 is anchored to the end of handle 15 and the other end of the cable is connected to latch 25. At the remote end of the handle, which is tubular, the end of cable 30 extends through a bore 31 in a plug 32 in the handle. Set screw 33 clamps the cable in bore 31. The other end of the cable passes loosely through holes 35 and 36 in shank 11 and latch 25 and is equipped with a ball end 37. Thus, the cable 30 assumes the position of a bowstring in relation to the bent handle 15 and deflection of the cable pivots the latch 25 away from hook point 17.

FIG. 2 illustrates the first manipulation of the hook 10 to insert the point 17 under the binding 20 in depression 21 in the bundle B. As the point 17 is forced under the binding 20 the binding deflects latch 25 against the closing force of spring 28 as illustrated. Then handle 15 is rocked downward on the fulcrum of the hook in depression 21 in the bundle causing binding 20 to clear the latch and allow spring 28 to close the latch as shown in FIG. 3. In these manipulations cable 30 is not included in the operator's grasp on handle 15 whereby latch 25 is free to close as soon as binding 20 has passed the end of the latch. The hook is thereby securely engaged under binding 20 and the unit package may then be lifted by chain 14 as shown in FIG. 1.

In order to release the hook 10 from binding 20, cable 30 is included in the grasp of handle 15 as shown in FIG. 4. The resulting deflection of cable 30 opens the latch 25 and by lifting on handle 15 the point 17 of the hook may be withdrawn from underneath the binding 20. Thus, the cable 30 operates as a latch release member extending along the handle in spaced relation thereto which may be included in the grasp on the handle when the latch is to be released and not included in the grasp on the handle when the latch is not to be released.

What is claimed is:

1. A lifting hook comprising a shank portion having a lifting connection in one end thereof, a hook portion on the other end of said shank portion projecting from one side of said shank portion, a safety latch arranged to close the gap between said shank and the point of the hook, an elongated handle rigidly mounted at one end on the opposite side of said shank, and a latch release member, said latch release member comprising a flexible tension member suspended between the opposite end of said handle and said shank portion and extending along said handle in spaced relation to a gripping portion of said handle so that an operator can grasp the handle alone to manipulate the hook without releasing the latch or can include said tension member in his grasp of the handle to release the latch while manipulating the hook.

2. A hook as defined in claim 1, said release member comprising a cable.

3. A hook as defined in claim 1, said latch being pivotally mounted on said shank and spring biased against said point of the hook.

4. A lifting hook comprising a shank portion having a lifting connection in one end thereof, a hook portion on the other end of said shank portion projecting from one side of said shank portion, a safety latch arranged to close the gap between said shank and the point of the hook, a handle rigidly mounted on the opposite side of said shank, and a latch release member extending along said handle in spaced relation thereto so that an operator can grasp the handle alone to mainipulate the hook without releasing the latch or can include said member in his grasp of the handle to release the latch while manipulating the hook, said release member comprising a cable, said cable having one end connected to said latch and its opposite end connected to said handle.

5. A hook as defined in claim 4 said handle being bent to hold said cable spaced away from the handle in the manner of a bowstring.

* * * * *